US010595567B2

(12) United States Patent
Kravchenko-Berezhnaya

(10) Patent No.: US 10,595,567 B2
(45) Date of Patent: Mar. 24, 2020

(54) CHILD JUMPSUIT

(71) Applicant: Aleksandra Vasilievna Kravchenko-Berezhnaya, Moscow (RU)

(72) Inventor: Aleksandra Vasilievna Kravchenko-Berezhnaya, Moscow (RU)

( * ) Notice: Subject to any disclaimer, the term of this patent is extended or adjusted under 35 U.S.C. 154(b) by 0 days.

(21) Appl. No.: 15/550,156

(22) PCT Filed: Oct. 19, 2016

(86) PCT No.: PCT/RU2016/000717
§ 371 (c)(1),
(2) Date: Aug. 10, 2017

(87) PCT Pub. No.: WO2017/209644
PCT Pub. Date: Dec. 7, 2017

(65) Prior Publication Data

US 2019/0075854 A1 Mar. 14, 2019

(30) Foreign Application Priority Data

May 30, 2016 (RU) ..... 2016120966

(51) Int. Cl.
*A41B 13/00* (2006.01)
*A41B 13/08* (2006.01)
*A41D 11/00* (2006.01)

(52) U.S. Cl.
CPC ..... *A41B 13/005* (2013.01); *A41B 13/08* (2013.01); *A41D 11/00* (2013.01);
(Continued)

(58) Field of Classification Search
CPC ..... A41B 13/005; A41B 2300/322; A41B 2300/324; A41B 13/08; A41B 2400/44; A41D 11/00
(Continued)

(56) References Cited

U.S. PATENT DOCUMENTS 1,758,740 A * 5/1930 Gale ..... A41B 13/005 2/78.2
2,448,438 A * 8/1948 Kessler ..... A41B 9/08 2/80
(Continued)

FOREIGN PATENT DOCUMENTS

GB 1085518 A * 10/1967 ..... A41D 13/04
JP 2005226191 A 8/2005
(Continued)

OTHER PUBLICATIONS

Merriam-Webster, "Cuff", https://www.merriam-webster.com/dictionary/cuff, last visited Feb. 22, 2019. (Year: 2019).*
(Continued)

*Primary Examiner* — Alissa L Hoey
*Assistant Examiner* — Patrick J. Lynch
(74) *Attorney, Agent, or Firm* — Dergostis & Noah LLP

(57) ABSTRACT

A child jumpsuit includes a back part, a front part with a fastener, and legs; the fastener is designed from the neck on the front part with a shift to the side from the central front line across the sitting line up to the lateral seam near the waist line level on the back. The proposed child jumpsuit provides for a more convenient use of the child jumpsuit, simplifying its design and increasing the wearer's comfort.

10 Claims, 2 Drawing Sheets

(52) U.S. Cl.
CPC ... *A41B 2300/322* (2013.01); *A41B 2300/324* (2013.01); *A41B 2400/44* (2013.01)

(58) Field of Classification Search
USPC ..... 2/69.5, 84, 80, 78.2, 96, 114
See application file for complete search history.

(56) References Cited

U.S. PATENT DOCUMENTS

| | | | | | |
|---|---|---|---|---|---|
| 2,523,416 | A * | 9/1950 | Brennan | A41B 13/005 | 2/80 |
| 2,675,554 | A * | 4/1954 | Gertz | A41D 19/0017 | 2/158 |
| 2,738,512 | A * | 3/1956 | Winer | A41B 13/005 | 2/69.5 |
| 2,769,177 | A * | 11/1956 | Morris | A41B 13/005 | 2/80 |
| 3,041,625 | A * | 7/1962 | Joseph | A41B 13/005 | 2/80 |
| 3,555,567 | A * | 1/1971 | Owen | A41B 13/005 | 2/69.5 |
| 8,832,864 | B1 | 9/2014 | Braden | | |
| 2009/0064390 | A1* | 3/2009 | Beiring | A41B 13/06 | 2/80 |
| 2011/0030117 | A1* | 2/2011 | Wolfson | A41D 10/00 | 2/80 |
| 2012/0054941 | A1 | 8/2012 | Brooks | | |
| 2013/0007940 | A1* | 1/2013 | Ryerson | A47G 9/068 | 2/80 |

FOREIGN PATENT DOCUMENTS

| | | | |
|---|---|---|---|
| RU | 12765 | U1 | 2/2000 |
| RU | 2484744 | C1 | 6/2013 |
| RU | 155069 | U1 | 9/2015 |

OTHER PUBLICATIONS

Waistline, https://www.apparelsearch.com/definitions/miscellaneous/waistline_definition.htm, last visited Aug. 19, 2019.*
International Search Report and Written Opinion for PCT/RU2016/000717, dated Apr. 27, 2017, 5 pages.
International Search Report and Written Opinion for PCT/RU2016/000717, dated Apr. 27, 2017, 6 pages (English Translation).

* cited by examiner

CHILD JUMPSUIT

CROSS-REFERENCES TO RELATED APPLICATIONS

This application is a U.S. National Phase of International Application No. PCT/RU2016/000717, filed on Oct. 19, 2016, which claims priority to and the benefit of Russian Patent Application No. 2016120966/12, filed on May 30, 2016, the entire contents of which are incorporated herein by reference.

TECHNOLOGY FIELD

This invention relates to clothing, and specifically to child jumpsuits.

PREVIOUS TECHNOLOGY LEVEL

From the technology level, a child jumpsuit is known that includes a one-piece back and front, which form a neck with a collar in the top part and legs in the bottom part, as well as sleeves; this jumpsuit is characterized in that the front is designed with a zip fastener or snap fasteners located in the middle of the front part or shifted to the right or left from the middle of the front part (Russian Federation utility model patent No. 12765, A41B13/00, published on Feb. 10, 2000).

A drawback of the known utility model is that it is difficult to change diapers and impossible to sit the child on the potty without taking the child's legs out of the jumpsuit legs.

A child jumpsuit is also known that includes a top head part with hood and a body part with sleeves and legs; the body part includes a detachable flap located on both sides of the jumpsuit's body part, and it's rear portion is widened up to the waist line (Russian Federation utility model patent No. 155069, A41B13/00, published on Sep. 20, 2015).

A drawback of the above-mentioned jumpsuit is the complexity of its design and a large number of rigid fastener parts touching the child's body.

The closest equivalent is a child jumpsuit that has legs and is divided into two vertical cloth pieces in the crotch area like a vest, which overlap one another and have fasteners in this area; also, the fastening of the vertical pieces of the jumpsuit material is provided from the middle of the body in the front and in the rear across the crotch, and the groin area on the jumpsuit legs is widened by flaring or folding and by deepening the sitting line down to the knee level (RF invention patent No. 2484744, A41B13/00, published on Jun. 20, 2013).

A drawback of this known jumpsuit consists in the overlapping of two cloth layers in the crotch area and in the unjustified widening of the groin area. This jumpsuit design requires great consumption of material and is difficult to use due to the need to hold the cloth layers. In addition, the fastener line of this jumpsuit passes across the crotch, which causes discomfort to the child.

SUBSTANCE OF THE INVENTION

The problem that the proposed invention intends to solve is to develop an improved child jumpsuit that would not have the drawbacks of the above-mentioned similar products, and to expand the range of tools intended for the above-mentioned purpose.

The technical result of the proposed invention consists in achieving a more handy use of the child jumpsuit, simplifying its design and increasing the wearer's comfort.

The technical result is achieved by the fact that the proposed child jumpsuit includes a back part, a front part with a fastener, and legs; the fastener is designed from the neck on the front part with a shift to the side from the central front line across the sitting line up to the lateral seam near the waist line level on the back.

It is appropriate to have the fastener designed from the neck on the front part with a shift to the side from the central front line across the sitting line up to the lateral seam near the waist line level on the back.

It is appropriate to have the jumpsuit designed with a lowered sitting line.

It is appropriate to have the jumpsuit designed with a widening from the waist line or from the chest line, and/or to be A-shaped.

It is appropriate to have the inner sides of the legs designed at an angle close to 45° to each other.

It is appropriate to have the fastener designed with an underside strip.

The jumpsuit can include sleeves with a length down to the mid-palm, and/or with cuffs. Also, each cuff can be designed with a possibility to have its rear part unrolled, which turns them into fingerless mittens for protection against self-inflicted injuries.

The legs can be designed with cuffs. Also, each cuff can be designed with a possibility to unroll its rear part, which completely covers the foot when unrolled.

BRIEF DESCRIPTION OF DRAWINGS

The invention is explained by the following figures.

IMPLEMENTATION OF THE INVENTION

Figure 1:
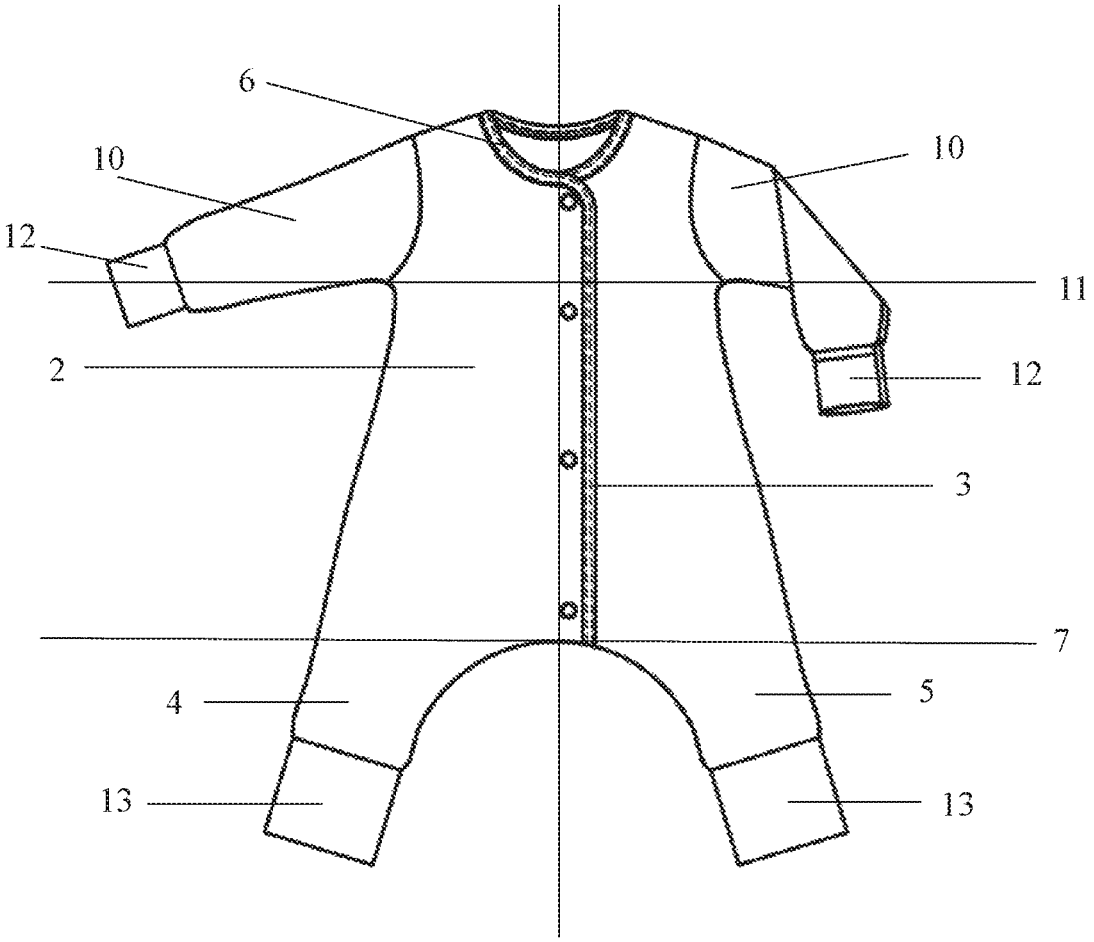
FIG. 1 shows the child jumpsuit (front view).
Figure 2:
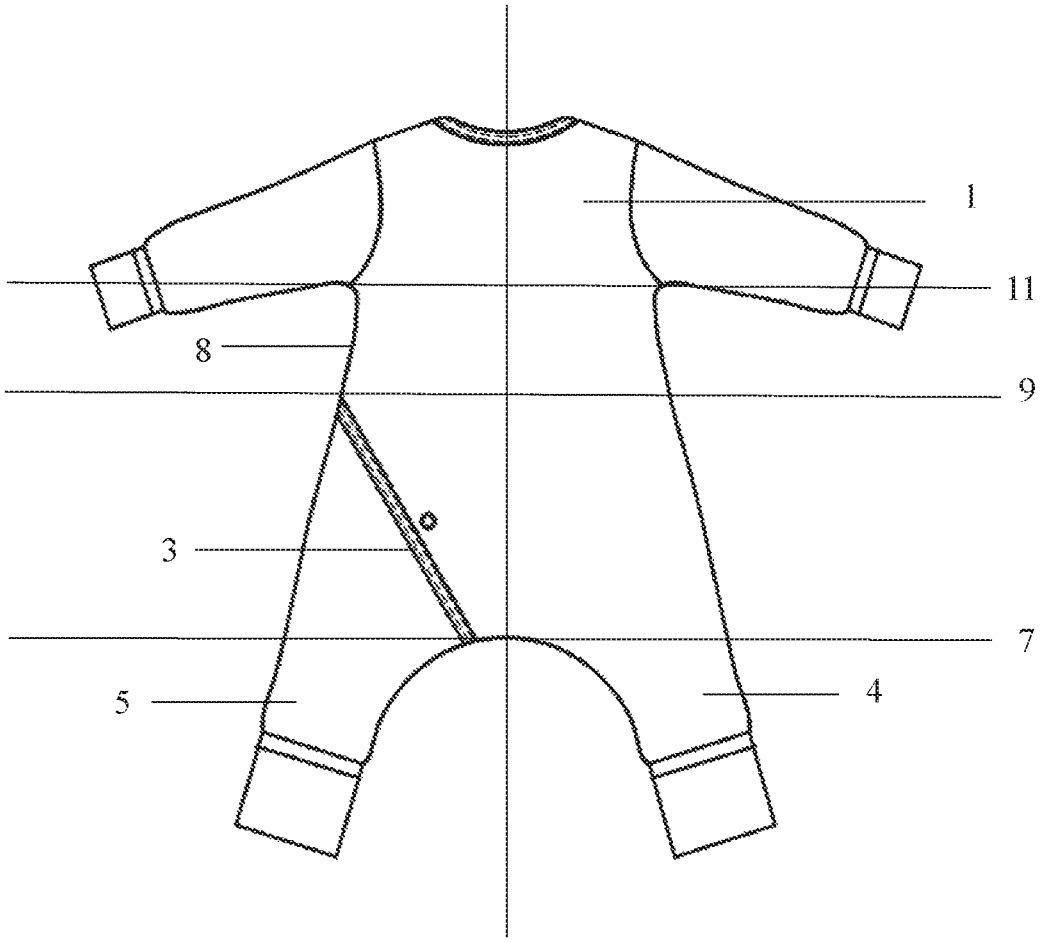
FIG. 2 shows the child jumpsuit (rear view).

In the preferred but not the only possible implementation option, the child jumpsuit includes a back 1, a front 2, sleeves 10, and legs 4, 5. At the front, the fastener 3 is designed vertically, with a shift to the side (right or left) from the central front line from the neck 6 to the sitting line 7 (groin). At the rear, the fastener 3 is designed from the sitting line 7 to the lateral seam 8 (left or right) near (slightly above or slightly below) or at the level of the waist line 9. Also, the sitting line 7 of the jumpsuit is designed to be lowered. At the rear, the fastener 3 allows to divide the rear part of the jumpsuit into a top piece, which includes the back 1 and one leg 4, and a bottom piece, which includes the other leg 5.

Shifting of the fastener 3 to the right or to the left (about 3 cm) from the central front line and moving the rear part of the fastener to the lateral seam 8 allows to avoid contact with the child's crotch and thereby increase the comfort level of the wearer.

The sleeves 10 of the jumpsuit are designed with cuffs 12 and/or have a length up to the mid-palm. Each cuff 12 is designed with a possibility to have its rear part unrolled, which turns them into fingerless mittens for protection against self-inflicted injuries.

The legs 4, 5 of the jumpsuit are designed with cuffs 13. Each cuff 13 is designed with a possibility to unroll its rear part, which completely covers the foot when unrolled.

The possibility to unroll the rear part of the cuff 12, 13 is ensured by its two-piece design: a lower piece made of two layers and an upper piece forming a pocket on the rear part of the cuff 12, 13.

A widening from the waist line 9 or from the chest line 11 and/or the A-shape of the jumpsuit allow to loosen the fit in the hips area. The positioning of the inner sides of the legs 4, 5 at about 45° angle to each other and the lowered sitting line 7 of the jumpsuit ensure additional looseness in the groin area. This cut of the jumpsuit allows easy fitting of a diaper, and, in combination with a special positioning of the fastener, allows to change diapers easily.

The fastener 3 of the jumpsuit is designed with a double-folded underside strip, which covers the fastener attachment area from the inside of the jumpsuit. The strip is designed to be about 3 cm wide and serves as a facing all along the perimeter of the fastener. This design of the fastener allows to avoid contact of the child's body with rough elements of the fastener, which also increases the comfort level of the wearer.

The fastener 3 can be designed with snap fasteners, zip fasteners, buttons, velcro strips, ties, hooks or other known fastening elements.

The product can also be trimmed along the neck 6 and the fastener 3 with bias tape made of the main material. The neck can have a collar. The jumpsuit can also have a hood and pockets.

The front 2 can be designed with a cut-off yoke, while the sleeves 10 can be designed as set-in or raglan.

The jumpsuit can be made of woven cotton cloth and/or other type of material.

INDUSTRIAL APPLICABILITY

The invention is to be used as follows.

The front fastener 3 is opened and the jumpsuit is put on the child. Then the fastener 3 is closed. If it is needed to access the child's lower body for hygienic procedures (for example, to change diapers, to put the child on a potty, etc.), the fastener 3 is opened at the lower part of the jumpsuit in the front and/or in the back as much as needed to perform the procedure. The design of the jumpsuit allows to perform any hygienic manipulations easily and quickly without taking it off and without taking the child's legs out of the jumpsuit legs.

The invention claimed is:

1. A child jumpsuit garment comprising an A-shaped unitary body with arm openings, a neck, and a sitting line, the body having (i) a front part having a left section and a right section, with a central front line; and (ii) a back part having a top piece and a bottom piece, with a waist line and a central back line;

legs extending from the sitting line of the body, the sitting line being orthogonal to the central front line, the waistline being located between the sitting line and the neck; and, a releasable fastener, designed to extend longitudinally from the neck on the front part, across the sitting line of the body, and then terminating at the waist line of the back part, the fastener positioned on the front part parallel to, and laterally shifted away from the central front line, the fastener including complimentary fasteners on the left section and the right section of the front part directly joining the left section to the right section and the fastener positioned on the back part to extend longitudinally from the sitting line of the body to the waist line at an acute angle relative to the central back line, and the fastener including complimentary fasteners on the top piece and the bottom piece of the back part directly joining the top piece to the bottom piece, the top piece including the arm openings and one leg, and the bottom piece including the other leg.

2. The child jumpsuit garment of claim 1 further comprising sleeves.

3. The child jumpsuit garment of claim 2 wherein the sleeves have a length configured to extend up to a mid-palm of a user when the garment is worn.

4. The child jumpsuit garment of claim 2, wherein each sleeve has a cuff.

5. The child jumpsuit garment of claim 4 wherein each cuff is configured to unroll its rear part, turning the cuff into a fingerless mitten for protection against self-inflicted injuries.

6. The child jumpsuit garment of claim 1 wherein each leg has a cuff.

7. The child jumpsuit garment of claim 6 wherein each cuff is configured to unroll its rear part and configured to completely cover a foot of a user when the garment is worn.

8. The child jumpsuit of claim 1, wherein the jumpsuit is widened from the waist line.

9. The child jumpsuit garment of claim 1 wherein the jumpsuit is widened from a chest line.

10. The child jumpsuit garment of claim 1 wherein the fastener has an underside strip.

* * * * *